US006561383B1

(12) United States Patent
Reddy et al.

(10) Patent No.: US 6,561,383 B1
(45) Date of Patent: May 13, 2003

(54) FOOD POUCH ASSEMBLY FOR DISPENSING A FLOWABLE FOOD PRODUCT FROM A CASSETTE-TYPE DISPENSER

(75) Inventors: Balakrishna Reddy, Ridgefield, CT (US); Eric E. Hartman, Ridgefield, CT (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 10/032,169

(22) Filed: Dec. 21, 2001

(51) Int. Cl.[7] ..... G01F 11/00

(52) U.S. Cl. ..... 222/1; 222/105; 222/146.1; 222/185.1; 222/325

(58) Field of Search ..... 222/1, 92, 105, 222/146.1, 183, 185.1, 325, 527

(56) References Cited

U.S. PATENT DOCUMENTS 3,112,047 A * 11/1963 Weinreich et al. ..... 222/105
4,601,410 A * 7/1986 Bond ..... 222/105
4,679,707 A * 7/1987 Sedam ..... 222/129.1
4,795,062 A * 1/1989 Bedwell et al. ..... 222/183
5,690,993 A * 11/1997 Malhotra et al. ..... 427/145
6,006,961 A * 12/1999 Wark ..... 222/1
6,105,821 A * 8/2000 Christine et al. ..... 222/105

* cited by examiner

*Primary Examiner*—Joseph A. Kaufman
(74) *Attorney, Agent, or Firm*—Winston & Strawn

(57) ABSTRACT

The invention relates to a pouch assembly that includes a main pouch body adapted to receive an amount of flowable food, a fitment member sealingly attached to the pouch on a lower portion of one side of the body, and an outlet demarcated by the fitment member. The lower portion is capable of flexing at substantially 90 degrees with respect to the rest of the body to orient the fitment member downward when the pouch is supported in a standing position for product delivery. Also, a spacer member is provided for at least partially engaging the fitment member to maintain a sufficient clearance between the outlet and the inside of the pouch to allow evacuation of the flowable product through the outlet. Such a pouch assembly is suitable for food delivery in a cassette-type dispenser.

11 Claims, 4 Drawing Sheets

FOOD POUCH ASSEMBLY FOR DISPENSING A FLOWABLE FOOD PRODUCT FROM A CASSETTE-TYPE DISPENSER

FIELD OF THE INVENTION

The invention relates to a food pouch assembly adapted for dispensing a flowable food product out of a food dispenser. More particularly, the invention relates to a pouch assembly adapted to fit in a dispenser using narrow profiled heated or cooled cassettes adapted to maintain the pouch in a standing position during product flow.

BACKGROUND OF THE INVENTION

Heated or refrigerated dispensers for delivering liquid or semi-liquid food products are commonly used in foodservice restaurants, catering, convenience stores and other commercial or public food establishments. The known dispensers are usually adapted for receiving food bags in a housing and for delivering the food by using pumps and/or gravity forces to a dispensing area.

It has been found that for reducing the heat-up time and improving the heating efficiency, the food pouch should preferably be inserted into a cassette that keeps the bag in a standing position while applying heat by intimately arranging the pouch in contact with the extensive walls of the cassette that are heated. This is disclosed in co-pending U.S. patent application Ser. No. 09/788,652. Furthermore, it has been found out that the flow of product is promoted when the product delivery is made through the bottom side of the cassette which corresponds to the lowest point in the cassette. Despite there improvements, it is not convenient and easy to seal a fitment on the edge of a pouch. There exist boat type fitments that can be sealed along the edge of the pouch but then the pouch cannot be filled by a standard aseptic filling machines.

In known prior art such as U.S. Pat. Nos. 6,223,944 and 6,056,157, the product is delivered through a hopper passage that is not in the bottom side but in the front of the hopper. As a result, full evacuation of the product cannot be properly obtained primarily since the fitment is not located at the lowest point in the hopper.

In U.S. Pat. Nos. 5,803,317 and 6,003,733, the product is delivered through a passage that is located through the bottom of the receptacle for the pouch. The pouch is not maintained standing along its sealed edge in the receptacle but has one of its two extensive surfaces contacting a sloped bottom of the receptacle. As a consequence of the pouch arrangement in the receptacle, product evacuation is still not optimal and depends on the slope of the bottom and furthermore a poor heat transfer is obtained.

Therefore, there is a need for new pouches that overcome these deficiencies.

SUMMARY OF THE INVENTION

The invention provides a pouch assembly that is adapted to stand in a position that improves product evacuation and product heating efficiency while the pouch is still compatible for filling with the standard filling machines. Another feature of the invention is that the pouch assembly can fit both a cassette-type dispenser in which the pouch is loaded along a vertical plane and the known dispensers which receive the pouch laying flat along a sloped or horizontal plane. This helps in lowering inventory costs and rationalizing management of product SKUs.

The pouch assembly of the invention advantageously comprises a main pouch body adapted to receive an amount of flowable food, and a fitment member sealingly attached to the pouch on a lower portion of one side of the body, wherein the lower portion is capable of flexing at substantially 90 degrees with respect to the rest of the body to orient the fitment downward when the pouch is supported in a standing position for product delivery. There is also provided a spacer means at least partially engaging the fitment to maintain a sufficient clearance inside the pouch to allow evacuation of the flowable product through the fitment.

the invention also relates to a method for improving delivery a flowable food product from a pouch assembly as aforementioned which comprises maintaining the body of the pouch standing in a substantially vertical support assembly comprising a bottom passage while flexing a lower portion of the pouch at substantially 90 degrees with respect to body of the pouch while the fitment of the pouch being located through the passage so as to orient itself downward and maintaining a sufficient clearance by a spacer between the outlet and the inside of the pouch to allow evacuation of the flowable product through the outlet.

DETAILED DESCRIPTION OF THE PREFERRED EMBODIMENT

Figure 2:
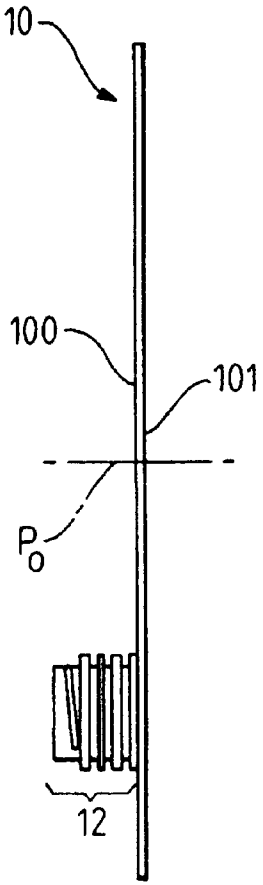
FIG. 2 is a longitudinal view of the pouch of FIG. 1.
Figure 1:
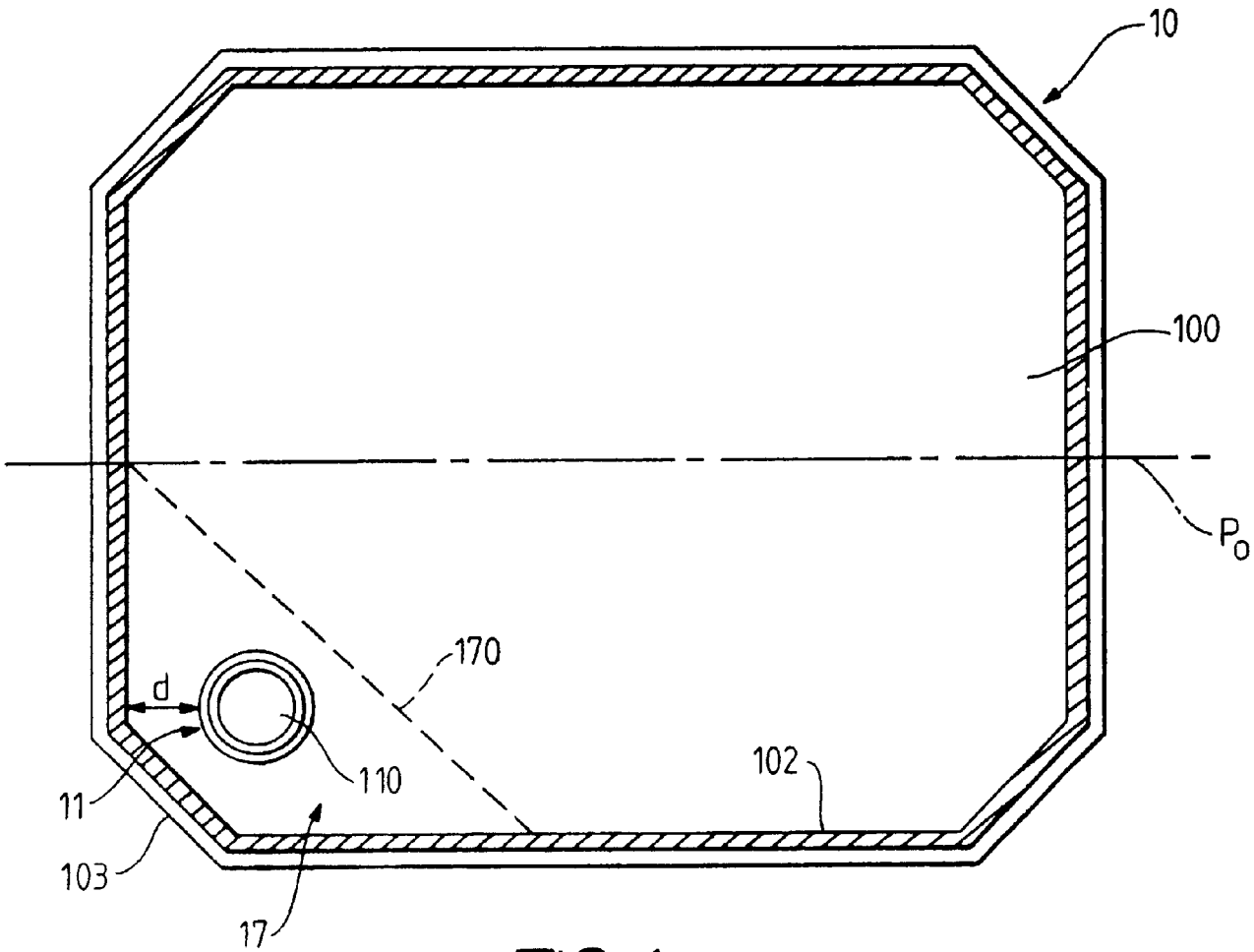
FIG. 1 is a side view of a pouch according to the invention.

FIGS. 1 and 2 illustrate the structure of the pouch and hose assembly according to the invention. A disposable, substantially rectangular or polygonal, thin-walled pouch 10 is adapted to contain a flowable food product such cheese sauce and the like to be dispensed. The flexible pouch is preferably made of plastic or another suitable material that can with stand heat, i.e., a temperature in excess of 140° F. The pouch preferably comprises two extensive sides 100, 101 sealed together along a peripheral sealed edge 102. Secured to a bottom corner region 17 of one of the pouch's side is the fitment 11 that defines an outlet 110 for dispensing the food product.

In a preferred embodiment, the bottom corner region has a truncated corner 103 to reduce the dead zone that is submitted to folding when the pouch is put into place in the cassette as it will be apparent in the next figures. Preferably, the fitment is located in region at a distance "d" from the edge 102 of the pouch that is sufficient to provide a proper folding of the corner region 17 along a line 170 that is inclined with respect to the median longitudinal plane $P_O$ of the pouch. If this distance "d" is too long, the portion submitted to folding may be too large which would cause problems to evacuate product from dead zones of the folded portion. If the distance is too short, the portion may have difficulties to fold properly and it may be difficult to engage the fitment through the passage. Furthermore, if the distance between the two plies 110, 101 of the pouch is too short due to the proximity of the corner, it could cause a problem to engage the spacer with risks of accidentally puncturing the pouch. Depending on the pouch and fitment's sizes, the distance from the edge may vary greatly. The pouch should approximately be between 1 to 3 inches to accommodate standard pouch capacities.

The fitment has usually an external thread or snap ring 12 for engagement with a cap (not shown) that tightly closes the pouch after filling with the food product for transportation and storage before the pouch is for the first time inserted in the dispensing device.

Figure 3:
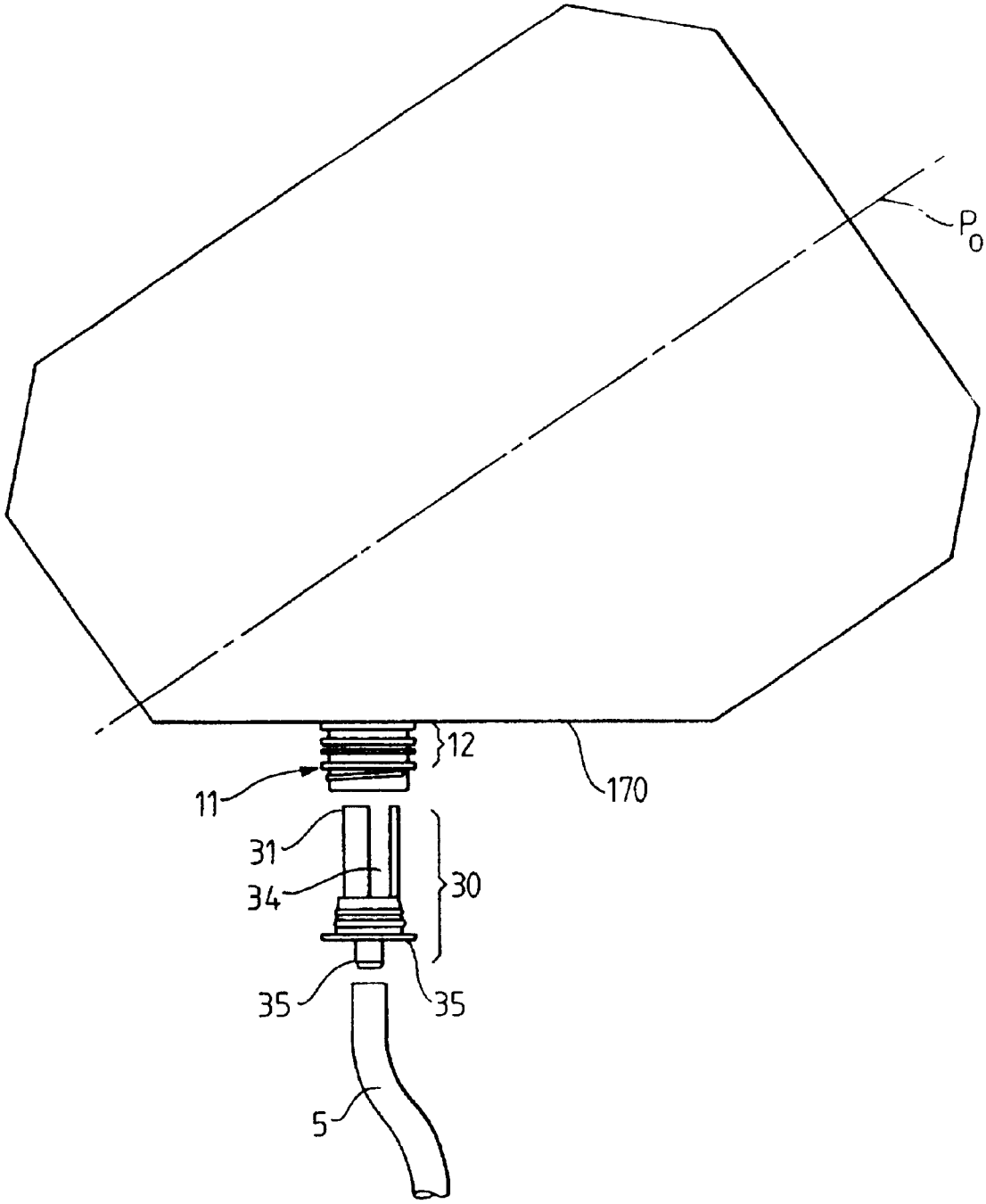
FIG. 3 is a side view showing the pouch assembly while the corner portion flexed.
Figure 4:
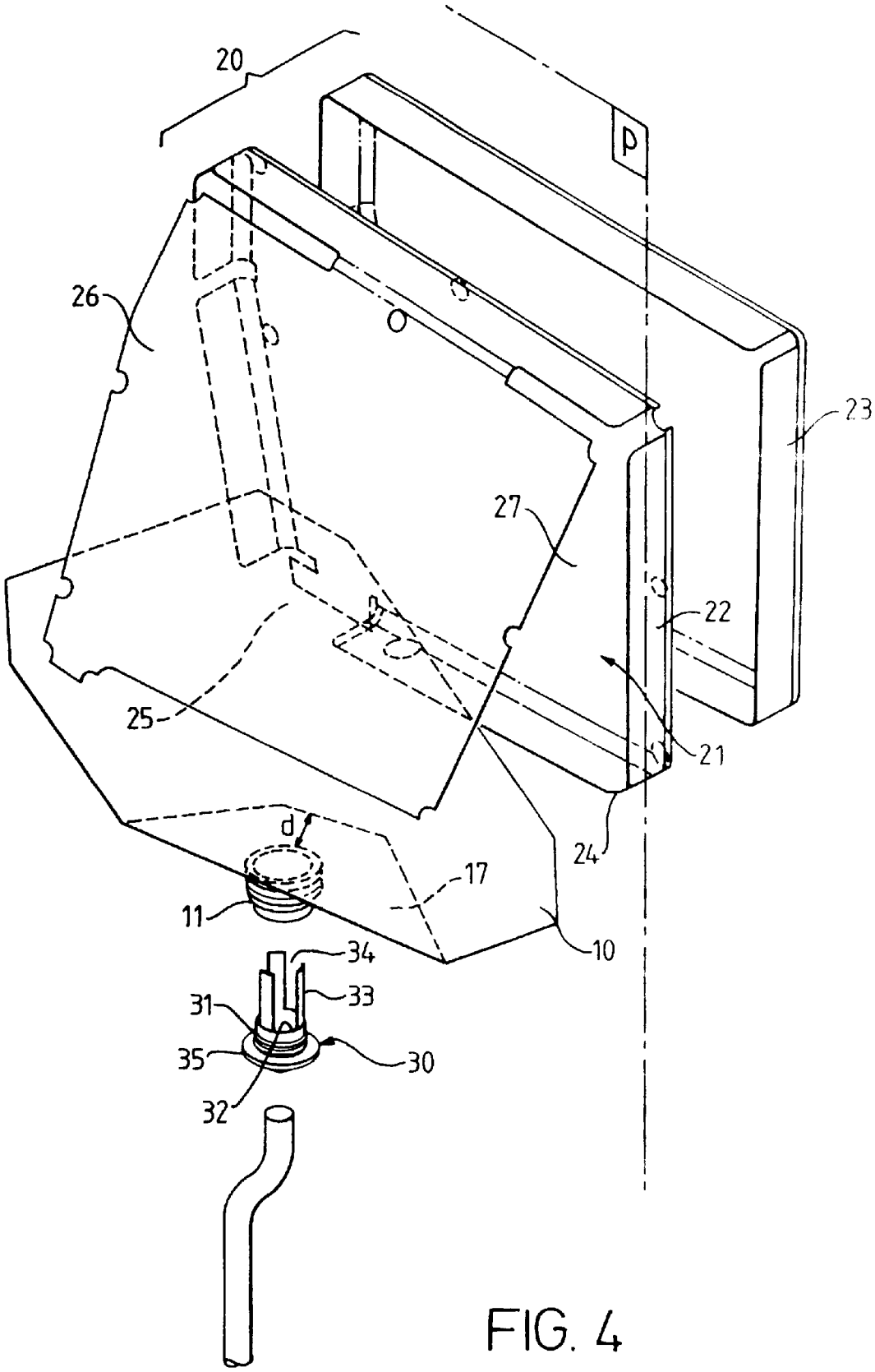
FIG. 4 is a view that illustrates the pouch assembly of the invention and its insertion in a heated cassette (partially shown)
Figure 5:
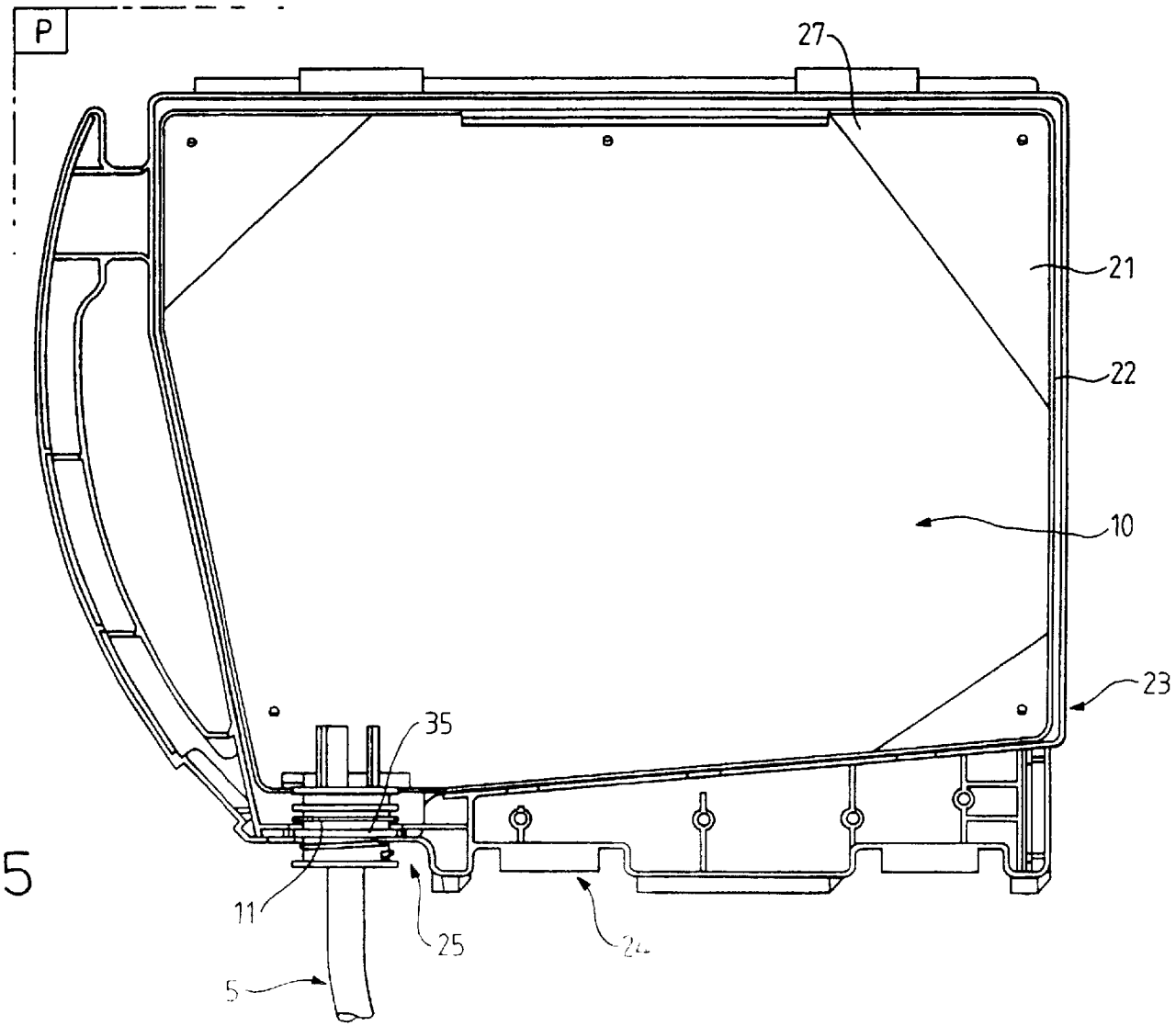
FIG. 5 is a cross-section view of the cassette and pouch assembly fitting the cassette.

FIGS. 3 to 5 illustrate the pouch assembly is inserted into a cassette assembly 20 in the interior 21 of a heating element 22 forming heating surfaces. The cassette has a general rectangular form with its axial plane P vertically oriented when the cassette is disposed in the dispensing unit for dispensing. The cassette may further comprise an insulating covering 23 that reduces the heat loss by radiation outside the boundaries of the cassette. The cassette is intended to stand upward in a dispensing unit as illustrated in FIG. 1 which its bottom side 24 facing downward. The bottom side has preferably a passage 25 for enabling the fitment 11 to stand therethrough at substantially the lowest point of the cassette 20 when the cassette is maintained in the vertical standing position. The bottom side supporting the pouch body may further present a sloped profile to increase the evacuation in direction of the passage.

As a consequence of its insertion within the interior of the cassette, the body of the pouch aligns itself along the axial plane P of the cassette whereas the corner region 17 that supports the fitment 11 is folded substantially at 90 degrees with respect to the rest of the body so that the fitment can properly orient itself downward through the intended passage 25 as it is more clearly apparent in FIGS. 3 and 4. As a result of that, the outlet of the fitment is put in a position that is the lowest of the pouch thereby improving the evacuation of the food in the cassette. At the same time, the body of the pouch has its two main sides intimately contacting the larger heating surfaces 26,27 of the cassette thereby rendering the heat transfer particularly effective.

According to the invention, a spacer means is provided under the form an adapter 30 that fits the fitment 11 via a thread 31 and has an aperture 32 able to establish fluid connection with the outlet 110 of the fitment. The spacer means has the function to maintain a sufficient clearance in the vicinity of the outlet inside the pouch where there is a risk for the pouch to collapse due to the folding of the corner portion 17. For that, the spacer means preferably axially engages the fitment 11 and has at least one internally protruding rigid element that extends beyond the outlet inside the pouch. Even more preferably, there are a plurality of prongs 33 extending axially and internally on the periphery of the aperture 32. The configuration of the prongs forms a sufficient clearance around the aperture while providing radial passages 34 of sufficient surface for not disturbing the flow of product form the interior of the pouch through the fitment assembly. The prongs keep the back side of the pouch from choking of the flow of product from the pouch. These prongs prove to be important to the vertical configuration of the cassette and very desirable for the horizontal or inclined flat configuration in traditional dispensing systems. As shown in FIG. 5, the adapter may comprise a transversally raising part 35 that fits in a slot of the cassette to secure the fitment assembly into place.

The pouch assembly further includes a discharge tube 5 that directs the flow of food product in a privilege area and can engage a volumetric displacement pump of the dispensing unit (not shown). The discharge tube 5 is connected to the pouch assembly by press fitting on a gland 35 of the adapter located at the terminal or lower end of the adapter.

The present invention embraces many variants that may be found equivalent to the preferred embodiment apparent in the figures. For instance, the spacer means could be made integral to the fitment 11 instead of being supported by the adapter. The fitment could thus protrude internally by prongs or any equivalent internally protruding elements. Another possible variant can consists in making the spacer means under the form of an apertured tubular member replacing the discontinuous spaced apart prongs. Another variant can consists in making the spacer means as a central rod attached to the outlet or aperture by radial ribs or a grid.

The benefit of having a fitment sealingly attached to a corner portion of the bag but still on one side of the pouch is that the pouch assembly of the invention can use the technology of the FDA approved preformed bags and be aseptically filled in standard filling machines. Preformed bags are commonly used in the food industry. Contrary to from-fill-seal bags, the preformed bags are produced with a capped fitment, sterilized and sent empty to a filling station either as separate bags or a chain of bags connected via a continuous web. Therefore the pouch of the invention may be produced from preformed bags that have a food capacity of from 3 to 10 liters, as approved by the U.S. Food and Drug Administration.

The pouch may also employ the form-fill-seal technology which consists in aseptically filling the bag from an upper edge that is subsequently sealed right after filling. In that event, the fitment would previously be sealed on the corner region as aforementioned. The outlet would have to be made by puncturing the pouch side inside the fitment to establish fluid connection. Puncturing may be carried out before engaging the adapter by using any suitable piercing element or by means of the adapter itself that pierces the pouch when securely engaging the fitment.

It is also within the scope of the invention to use such a pouch assembly in a cassette-type dispenser or similar for cold food products wherein the pouch is cooled in the cassette by suitable cooling means.

The terms "vertical" or "standing" in the present invention refer to a position or configuration strictly vertical or close to vertical so that flow of product by gravity is promoted. In particular, a pouch standing at an acute angle to vertical would still fall into the scope of the present invention.

The pouch assembly of the present invention finds an immediate application in the cassette-type dispensing device of the co-pending U.S. patent application Ser. No. 09/788,652 and a co-pending U.S. patent application filed Dec. 21, 2001 by Antonio Guttierrez and Balakrishna Reddy entitled "Compartmentalized Dispensing Device And Method For Dispensing A Flowable Product Therefrom" (W+S Ref. 88265–7186), the content of each of which are expressly incorporated herein by reference. Such a pouch assembly could as well be utilized for other applications that would not necessarily be the same as those of the co-pending patent applications. In particular, the pouch assembly would as well fit within traditional dispenser systems where the pouch is laying flat on a bottom side of a receptacle.

What is claimed is:

1. Pouch assembly comprising a main pouch body adapted to receive an amount of flowable food, a fitment member sealingly attached to the pouch on a lower portion of one side of the body, wherein the lower portion is capable of flexing at substantially 90 degrees with respect to the rest of the body to orient the fitment member downward when the pouch is supported in a standing position for product delivery, and a spacer member configured to maintain a sufficient clearance inside the pouch to allow evacuation of the flowable product through the fitment member, wherein the spacer member axially engages and is positioned within the fitment member and is insertable into the fitment member from outside the pouch when the pouch is filled with the flowable food, and the spacer member has at least one internally protruding rigid element that extends rigidly and axially beyond the fitment member and into the pouch.

2. Pouch assembly according to claim 1, wherein the spacer member is part of an adapter that complementary fits the fitment member and has an aperture to establish fluid connection.

3. Pouch assembly according to claim 2, wherein the spacer member comprises a plurality of prongs extending on the periphery of the aperture.

4. Pouch assembly according to claim 2, wherein the adapter has a gland to receive a discharge tube.

5. Pouch assembly according to claim 1, wherein the fitment member is seated to one side of a corner portion of the pouch so that the corner portion is capable of folding at 90 degrees with respect to the remainder of the pouch.

6. Pouch assembly according to claim 5, wherein the corner portion is truncated.

7. Pouch assembly according to claim 1, wherein spacer member is an integral part of the fitment.

8. A method for improving delivery of a flowable food product from a pouch assembly according to claim 1, which comprises maintaining the body of the pouch standing in a substantially vertical support assembly that includes a bottom passage while flexing the lower portion of the pouch at substantially 90 degrees with respect to the body of the pouch while the filament member of the pouch extends through the passage so as to orient itself downward and maintaining a sufficient clearance by the spacer member between the outlet and the inside of the pouch to allow evacuation of the flowable product through the outlet.

9. Method according to claim 8, wherein the spacer member is a part of an adapter that is capable of establishing fluid connection with a discharge tube.

10. Method according to claim 8 wherein the vertical support assembly is a cassette.

11. Method according to claim 10 which further comprises heating or cooling the flowable food product by and in the cassette.

* * * * *

UNITED STATES PATENT AND TRADEMARK OFFICE

CERTIFICATE OF CORRECTION

PATENT NO. : 6,561,383 B1
DATED : May 13, 2003
INVENTOR(S) : Reddy et al.

It is certified that error appears in the above-identified patent and that said Letters Patent is hereby corrected as shown below:

Column 5,
Line 23, change “seated” to -- sealed --.

Column 6,
Line 3, change “wherein spacer” to -- wherein the spacer --.
Line 11, change “filament” to -- fitment --.

Signed and Sealed this

First Day of July, 2003

JAMES E. ROGAN
*Director of the United States Patent and Trademark Office*